US009960540B2

(12) United States Patent
Sinha et al.

(10) Patent No.: US 9,960,540 B2
(45) Date of Patent: May 1, 2018

(54) CONNECTOR DEVICE

(71) Applicant: Yazaki Corporation, Tokyo (JP)

(72) Inventors: Abhishek Kumar Sinha, Makinohara (JP); Yoshimi Wada, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/446,081

(22) Filed: Mar. 1, 2017

(65) Prior Publication Data

US 2017/0256891 A1 Sep. 7, 2017

(30) Foreign Application Priority Data

Mar. 3, 2016 (JP) ..... 2016-041356

(51) Int. Cl.
*H01R 9/03* (2006.01)
*H01R 13/641* (2006.01)
*H01R 13/506* (2006.01)

(52) U.S. Cl.
CPC ..... *H01R 13/641* (2013.01); *H01R 13/506* (2013.01)

(58) Field of Classification Search
CPC .. H01R 13/641; H01R 13/506; H01R 13/436; H01R 13/4361; H01R 13/4365; H01R 13/4364; H01R 13/4367; H01R 13/4223; H01R 13/514
USPC ..... 439/656, 595, 357
See application file for complete search history.

(56) References Cited

U.S. PATENT DOCUMENTS 4,820,198 A * 4/1989 Lulko ..... H01R 13/4364 439/595
4,946,398 A * 8/1990 Takenouchi ..... H01R 13/4368 439/595
4,959,023 A * 9/1990 Watanabe ..... H01R 13/436 439/594
5,145,419 A * 9/1992 Yamanashi ..... H01R 13/4368 439/595

(Continued)

FOREIGN PATENT DOCUMENTS

JP 3-131064 U 12/1991
JP 8-222312 A 8/1996
JP 2011108576 A 6/2011

OTHER PUBLICATIONS

Communication dated Feb. 27, 2018, issued by the Japanese Patent Office in counterpart Japanese Patent Application No. 2016-041356.

*Primary Examiner* — Abdullah Riyami
*Assistant Examiner* — Vladimir Imas
(74) *Attorney, Agent, or Firm* — Sughrue Mion, PLLC

(57) ABSTRACT

A connector device includes a pair of connectors including a pair of housings that has terminal housing chambers housing terminals and a pair of front holders that is attached to the pair of the housings to double-lock the terminals in the terminal housing chambers, wherein one of the pair of front holders has a first convex portion protruding in a direction approaching the other of the pair of front holders and a first concave portion recessed in a direction away from the other of the pair of front holders, the other of the pair of front holders has a second convex portion protruding in a direction approaching the one of the pair of front holders and a second concave portion recessed in a direction away from the one of the pair of front holders.

5 Claims, 17 Drawing Sheets

(56) References Cited

U.S. PATENT DOCUMENTS

| | | | | | |
|---|---|---|---|---|---|
| 5,292,261 | A * | 3/1994 | Hirano | H01R 13/4368 | 439/595 |
| 5,370,543 | A * | 12/1994 | Hamada | H01R 13/641 | 439/188 |
| 5,618,201 | A * | 4/1997 | Yagi | H01R 13/6275 | 439/188 |
| 5,713,761 | A | 2/1998 | Okayasu | | |
| 5,931,700 | A * | 8/1999 | Saito | H01R 13/4365 | 439/489 |
| 5,967,859 | A * | 10/1999 | Cecil, Jr. | H01R 13/4368 | 439/595 |
| 7,112,104 | B2 * | 9/2006 | Sagawa | H01R 13/4365 | 439/595 |
| 7,114,997 | B2 * | 10/2006 | Sagawa | H01R 13/4365 | 439/595 |
| 7,264,505 | B2 * | 9/2007 | Miyakawa | H01R 13/4364 | 439/595 |
| 7,435,137 | B2 * | 10/2008 | Onoda | H01R 13/506 | 439/595 |
| 7,749,023 | B2 * | 7/2010 | Simmel | H01R 13/4362 | 439/572 |
| 8,684,759 | B2 * | 4/2014 | Adachi | H01R 13/516 | 439/262 |
| 9,095,053 | B2 * | 7/2015 | Trolese | H05K 5/02 | |
| 9,306,326 | B2 * | 4/2016 | Nishiyama | H01R 13/4362 | |
| 9,728,884 | B1 * | 8/2017 | Sinha | H01R 13/4364 | |
| 9,774,125 | B2 * | 9/2017 | Furuya | H01R 13/4538 | |

* cited by examiner

20 FEMALE SIDE FRONT HOLDER (FRONT HOLDER)
24 CONVEX PORTION
25 CONCAVE PORTION
40 MALE SIDE FRONT HOLDER (FRONT HOLDER)
43 CONVEX PORTION
44 CONCAVE PORTION

CONNECTOR DEVICE

CROSS REFERENCE TO RELATED APPLICATION

This application is based on Japanese Patent Application No. 2016-041356 filed on Mar. 3, 2016, the contents of which are incorporated herein by reference.

1. TECHNICAL FIELD

The present invention relates to a connector device including a connector and a counterpart connector.

2. BACKGROUND ART

A connector device has conventionally been proposed that has a mechanism for detecting whether terminals are normally housed in terminal housing chambers of the connector or not (specifically, the presence or absence of a halfway inserted state of the terminals) and more ensuring the prevention of coming-off of the normally housed terminals. For example, a connector of a back-ground art (hereinafter, referred to as back-ground art connector) is provided with a housing having terminal housing chambers and a front holder attached to the housing from the front side of the housing (for example, see JP-A-2011-108576).

In the back-ground art connector device, when the terminals are not normally housed in the terminal housing chambers (the terminals are in the halfway inserted state), the terminals push out lances of a cantilever in the housing, whereby the lances are in a state of being bent so as to enter the space where a double locking portion of the front holder is inserted. For this reason, the front holder cannot be inserted up to a regular locking position. By using this, the presence or absence of the halfway inserted state of the terminals is detected.

Further, in the back-ground art connector, in the state where the terminals are normally housed in the terminal housing chambers and the front holder is attached to the regular locking position, the double locking portion of the front holder pushes the lances in toward the terminals. For this reason, a double locking state is obtained where the lances lock the terminals and the double locking portion of the front holder locks the lances (in a regular position where the coming-off prevention function is fulfilled).

By this double locking, the prevention of coming-off of the terminals normally housed in the terminal housing chambers is more ensured.

In the back-ground art connector, when the terminals are in the halfway inserted state, since the front holder cannot be inserted up to the regular locking position, the front end surface of the front holder is normally in a state of protruding from the front end surface of the housing. However, because of variations in the dimensional accuracy and the like of the female housing and the front holder, even though the terminals are in the halfway inserted state, there are cases where the front holder can move to a position close to the regular locking position. In these cases, although the female terminals are in the halfway inserted state, there is a possibility that the front end surface of the front holder appears not to protrude from the front end surface of the housing. As a result, there is a possibility that the worker does not notice the halfway inserted state of the terminals.

When the terminals are in the halfway inserted state, there is a possibility that when the connectors are fitted, a position shift or the like of the terminals occurs and this makes the electrical connection between the connectors insufficient. Therefore, from the viewpoint of the reliability of the electric connection, it is desirable that the halfway insertion of the terminals is detected as surely as possible.

The present invention is made in view of the above-mentioned circumstances, and an object thereof is to provide a connector device capable of detecting the halfway insertion of the terminals as surely as possible.

SUMMARY OF INVENTION (1) According to an aspect of the invention, a connector device includes a pair of connectors including:

a pair of housings that has terminal housing chambers housing terminals; and a pair of front holders that is attached to the pair of the housings to double-lock the terminals in the terminal housing chambers, wherein one of the pair of front holders has a first convex portion protruding in a direction approaching the other of the pair of front holders and a first concave portion recessed in a direction away from the other of the pair of front holders, on a front end surface thereof that faces the other of the pair of front holders when the pair of connectors are fitted, the other of the pair of front holders has a second convex portion protruding in a direction approaching the one of the pair of front holders and a second concave portion recessed in a direction away from the one of the pair of front holders, on a front end surface thereof that faces the one of the pair of front holders when the pair of connectors are fitted, and the first convex portion is inserted into the second concave portion, the second convex portion is inserted into the first concave portion, and the front end surfaces of the pair of front holders are in contact with each other.

(2) In the connector device of (1), the one of the pair of front holders has a plurality of the first convex portions and a plurality of the first concave portions, and the other of the pair of front holders has a plurality of the second convex portions as many as the first convex portions and a plurality of the second concave portions as many as the first concave portions.

(3) In the connector device of (1) or (2), a common holder may be used as each of the one of the pair of front holders and the other of the pair of front holders.

According to the connector device of the structure of the above (1), the front end surface of one of the pair of front holders is formed of the first convex portion and the first concave portion so as to be uneven, and the front end surface of the other of the pair of front holders are formed of the second convex portion and the second concave portion so as to be uneven. For this reason, even when the front holders move to positions close to a regular locking position when the terminals are in halfway inserted state, the frontward protrusion of the front holders (particularly, the protrusion of the first concave portion or the second convex portion) is conspicuous compared with when the front end surface of the front holder is flat. As a result, the worker more readily recognizes the halfway inserted state of the terminals.

Further, according to the connector device of this structure, even though the convex portions (the first convex portion and the second convex portion) are formed on the front end surfaces of the front holders, the convex portions of one front holder are inserted in the concave portions of the other front holder when the connectors are fitted. Therefore, even though the convex portions are provided on the front end surfaces of the front holders, increase in the size of the connector device can be avoided.

Consequently, the connector device of this structure is capable of detecting the halfway insertion of the terminals as surely as possible while avoiding increase in the size of the connector device.

According to the connector of the structure of the above (2), the front holders have a plurality of convex portions and concave portions. For this reason, when the terminals are in the halfway inserted state, the frontward protrusion of the front holder is further conspicuous. Therefore, the connector device of the present structure can further surely detect the halfway insertion of the terminals.

According to the connector device of the structure of the above (3), a common holder may be used as each of the one and the other of the pair of front holders. For this reason, compared with when a common holder cannot be used as each of the pair of front holders (the configurations thereof are different), the number of components of the connectors can be reduced, whereby the component management and the like at the time of manufacture of the connectors is facilitated. Further, since it is unnecessary to prepare an individual (different) manufacturing mold and the like for each of the front holders, the manufacturing cost of the pair of front holders can be reduced, so that the manufacturing cost of the connectors can be reduced. To enable the use of a common holder as each of the one and the other of the pair of front holders, for example, the following structure is adopted: The first convex portions and the second convex portions have substantially the same configuration, the first concave portions and the second concave portions have substantially the same configuration, and the other parts of the front holders also have substantially the same configurations.

According to the present invention, a connector capable of preventing a position shift of the front holders as much as possible can be provided. Further, the component management at the time of manufacture of the connectors is facilitated, and the manufacturing cost of the connector can be reduced.

The present invention has been briefly described above. Further, details of the present invention will be further clarified by reading through the mode for carrying out the invention (hereinafter, referred to as "embodiment") described below with reference to the attached drawings.

BRIEF DESCRIPTION OF THE DRAWINGS

FIG. 2A shows a state where the front holder is in the middle of being inserted (a state where it is in a "temporary" locking position), and FIG. 2B is a view showing a state where the front holder is completely inserted (a state where it is in a "regular" locking position).

FIG. 4A is an A-A cross-sectional view, and FIG. 4B is a B-B cross-sectional view.

FIG. 5A is an A-A cross-sectional view, and FIG. 5B is a B-B cross-sectional view.

FIG. 7A is a C-C cross-sectional view in a state where the male side front holder is in the middle of being inserted, and FIG. 7B is a C-C cross-sectional view in a state where the male side front holder is completely inserted.

FIG. 9A is a perspective view of the female side front holder, and FIG. 9B is a D-D cross-sectional view of FIG. 9A.

FIG. 10A is a perspective view of the female housing, and FIG. 10B is an E-E cross-sectional view of FIG. 10A.

FIG. 12A is a view when the female housing is viewed from the front side, FIG. 12B is an enlarged view of an area F on the periphery of the protrusions, and FIG. 12C is a G-G cross-sectional view.

FIG. 13A is a view showing a state where the female side front holder is in the middle of being inserted, and FIG. 13B is a view showing a state where the female side front holder is completely inserted.

FIG. 16A is a perspective view of the male housing viewed obliquely from the front, and FIG. 16B is an enlarged view of an area H on the periphery of the innermost part of the guide groove. In FIG. 16B, for convenience' sake, illustration of the front holder 40 is omitted.

FIG. 17A is a front view of the male housing, FIG. 17B shows a state where a detachment jig is inserted along the guide groove in an I-I cross-sectional view, and FIG. 17C shows a state where the detachment jig is hooked on the front holder and drawn out in the I-I cross-sectional view.

DETAILED DESCRIPTION OF EMBODIMENT

Figure 1:
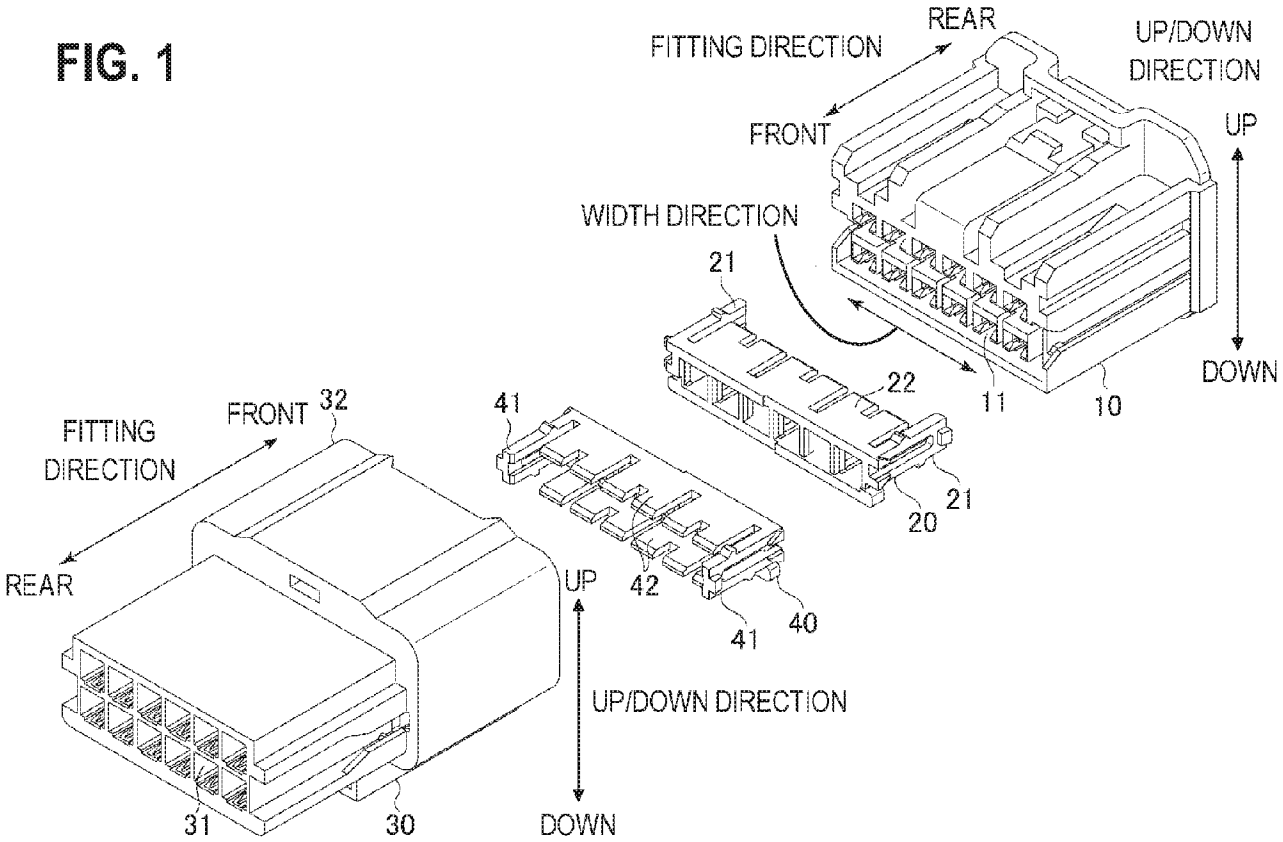
FIG. 1 is a schematic perspective view of a connector of an embodiment of the present invention.

Hereinafter, referring to the drawings, a connector device according to an embodiment of the present invention will be described. In all the drawings mentioned below, for reasons such as facilitation of explanation of members, illustrations of the terminals and the electric wires extending from the terminals are omitted.

(General Structure)

As shown in FIG. 1, the connector device according to the embodiment of the present invention is formed of a connector having a female housing 10 and a female side front holder (hereinafter, referred to as "front holder" simply) 20 and a counterpart connector having a male housing 30 and a male side front holder (hereinafter, referred to as "front holder" simply) 40. A "fitting direction", a "width direction", an "up/down direction", a "front", a "rear", an "up" and a "down" are defined as shown in FIG. 1. The "fitting direction", the "width direction" and the "vertical direction" are perpendicular to one another.

Inside the female housing 10, a plurality of (in this example, a total of twelve: six in the width direction and two in the vertical direction) terminal housing chambers 11 are formed in the fitting direction. In the female housing 10, a plurality of (in this example, twelve) female terminals connected to the end portions of a plurality of electric wires, respectively, are inserted into the corresponding terminal housing chambers 11 from the rear side, and then, the front holder 20 is attached from the front side.

The front holder 20 is provided with a pair of arms 21 protruding rearward at both end portions in the width direction and a plurality of (in this example, twelve) tabular double locking portions 22 protruding rearward in positions corresponding to the plurality of terminal housing chambers 11, respectively. As described later, the pair of arms 21 and the plurality of double locking portions 22 have the function of detecting whether the female terminals are normally housed in the terminal housing chambers 11 or not (specifically, the presence or absence of the halfway inserted state of the female terminals) and the function of more ensuring the prevention of coming-off of the normally housed female terminals.

Inside the male housing 30, as inside the female housing 10, a plurality of (in this example, a total of twelve: six in the width direction and two in the vertical direction) terminal housing chambers 31 are formed in the fitting direction. In the male housing 30, a plurality of (in this example, twelve) male terminals connected to the end portions of a plurality of electric wires, respectively, are inserted into the corresponding terminal housing chambers 31 from the rear side, and then, the front holder 40 is attached from the front side. For purposes such as protection of the end portions (tap portions) of the male terminals, a tubular surrounding portion (hollow portion) 32 surrounding the end portions of the male terminals is integrally provided on the front side of the male housing 30.

The front holder 40 has substantially the same configuration as the front holder 20. That is, the front holder 40 is provided with a pair of arms 41 protruding rearward at both end portions in the width direction and a plurality of (in this example, twelve) tabular double locking portions 42 protruding rearward in positions corresponding to the plurality of terminal housing chambers 31, respectively. The pair of arms 41 and the plurality of double locking portions 42 have the function of detecting whether the male terminals are normally housed in the terminal housing chambers 31 or not (specifically, the presence or absence of the halfway inserted state of the male terminals) and the function of more ensuring the prevention of coming-off of the normally housed male terminals.

As described above, the front holder 20 and the front holder 40 have substantially the same configuration (A more specific configuration will be described later. For example, see FIG. 9A, 9B and FIG. 14A, 14B.). For this reason, the front holder 20 can be attached to the male housing 30 instead of the front holder 40. Conversely, the front holder 40 can be attached to the female housing 10 instead of the front holder 20. That is, a common holder may be used as each of the front holder 20 and the front holder 40.

Figure 2A:
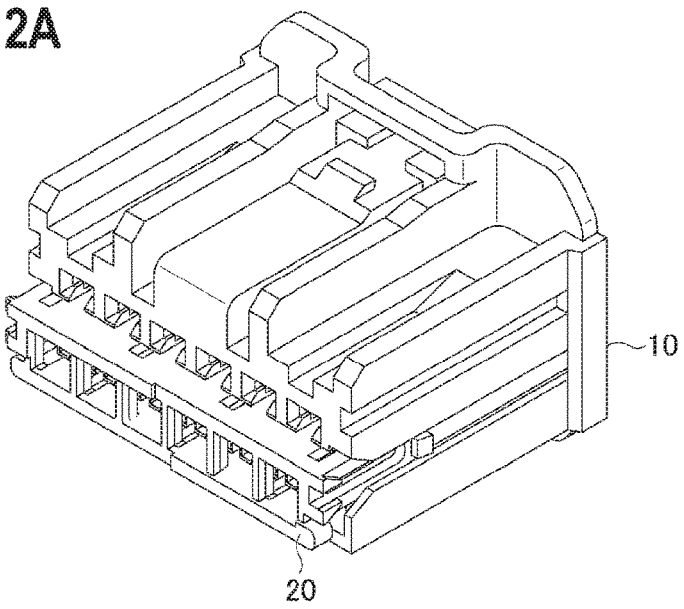
FIGS. 2A and 2B show states where a female side front holder is attached to a female housing shown in FIG. 1.
Figure 2B:
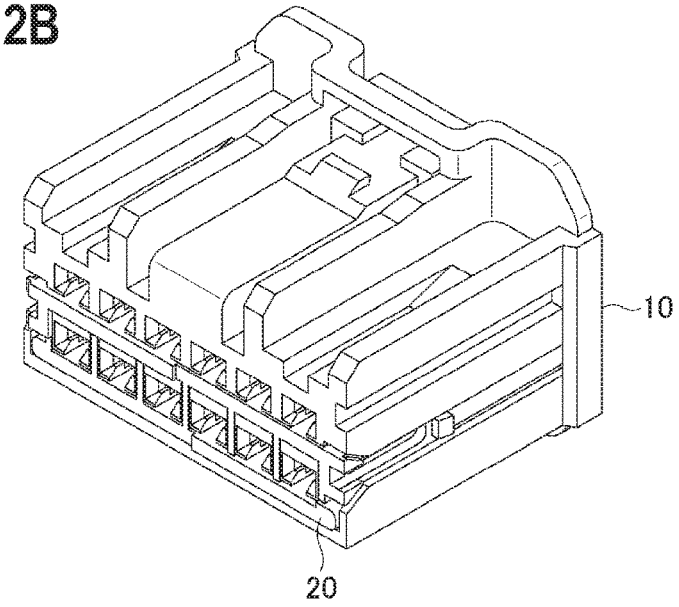

As shown in FIG. 2A and FIG. 2B, the front holder 20 is inserted into the female housing 10 from the front side, and inserted up to a "regular" locking position (state where the front holder 20 is completely inserted) shown in FIG. 2B by way of a "temporary" locking position (state where the front holder 20 is in the halfway inserted state) shown in FIG. 2A.

Figure 3:
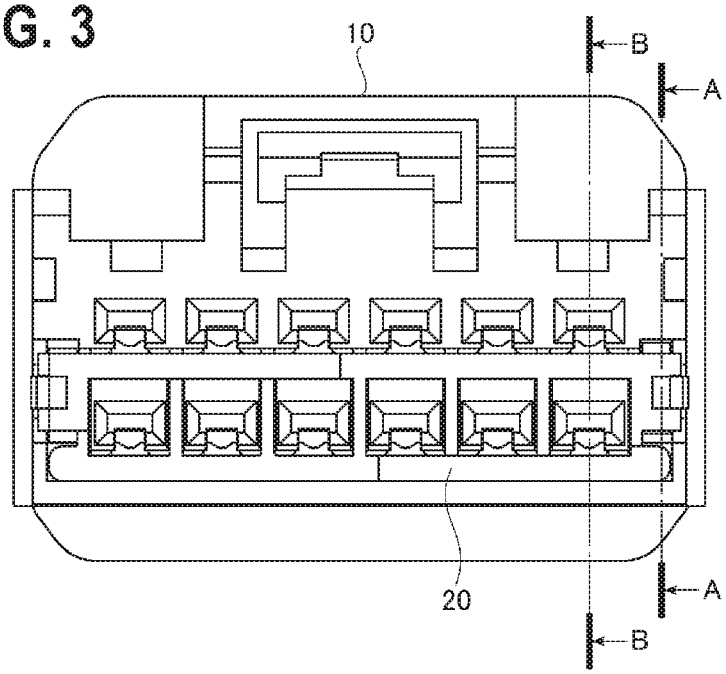
FIG. 3 is a view when the female housing shown in FIG. 1 is viewed from the front side.
Figure 4A:
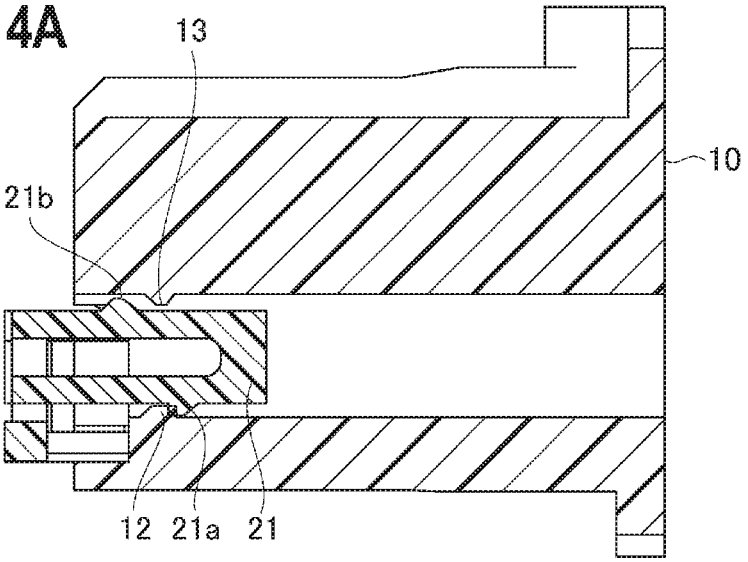
FIGS. 4A and 4B show cross-sectional views in a state where the female side front holder is in the middle of being inserted into the female housing shown in FIG. 1 (the state of FIG. 2A)

In the state where the front holder 20 is in the "temporary" locking position shown in FIG. 2A, as shown in FIG. 4A (the A-A cross section of FIG. 3), a protrusion 21*a* (see also FIGS. 9A, 9B) provided on the arm 21 climbs over a protrusion 12 provided on the female housing 10, whereas a protrusion 21*b* (see also FIG. 9A, 9B) provided on the arm 21 does not climb over a protrusion 13 provided on the female housing 10. Therefore, the front holder 20 can be held in the "temporary" locking position as long as no external force acts thereon.

Figure 4B:
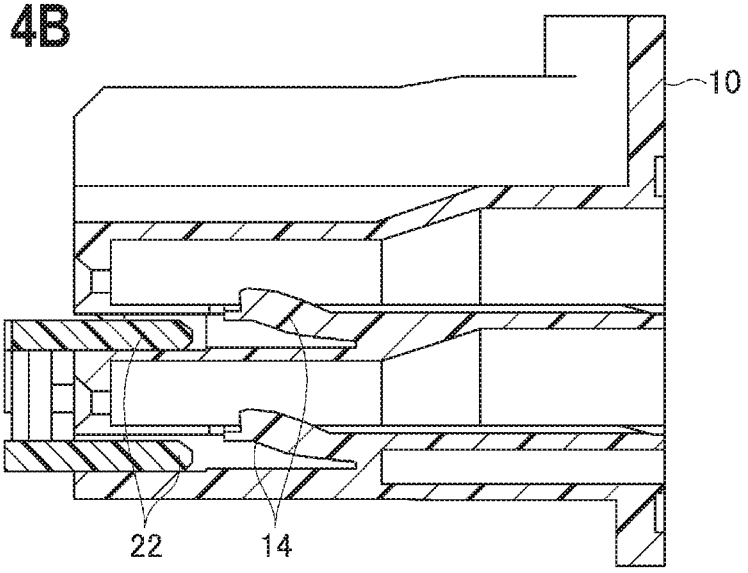

Moreover, in the state where the front holder 20 is in the "temporary" locking position, as shown in FIG. 4B (the B-B cross section of FIG. 3), the double locking portions 22 do not reach the positions of lances 14 provided in the female housing 10. The lances 14 are provided so as to correspond to the terminal housing chambers 11, respectively.

The lances 14 are locking pieces extending frontward and obliquely upward, and the end portions of the lances 14 enter the terminal housing chambers 11 from the openings formed on the lower surfaces of the terminal housing chambers 11. In the state where the female terminals are normally housed in the terminal housing chambers 11, the end portions of the lances 14 lock the locking portions of the female terminals housed in the terminal housing chambers 11, thereby preventing coming-off of the female terminals.

On the other hand, in the state where the female terminals are not normally housed in the terminal housing chambers 11 (the halfway inserted state of the female terminals), the female terminals push the lances 14 downward, whereby the lances 14 are in a state of being bent to positions where they enter the space where the front holder 20 is inserted. For this reason, the front holder 20 cannot be inserted up to the "regular" locking position. By using this, the presence or absence of the halfway inserted state of the female terminals can be detected.

Figure 5A:
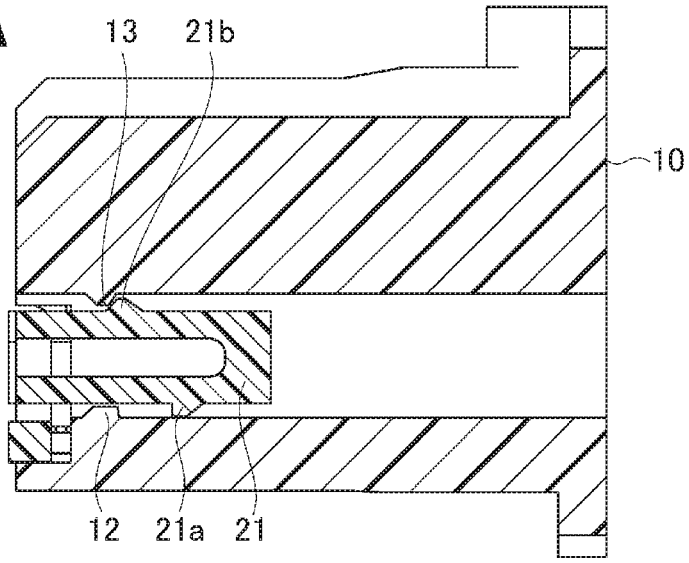
FIGS. 5A and 5B show cross-sectional views in a state where the female side front holder is completely inserted in the female housing shown in FIG. 1 (the state of FIG. 2B)
Figure 5B:
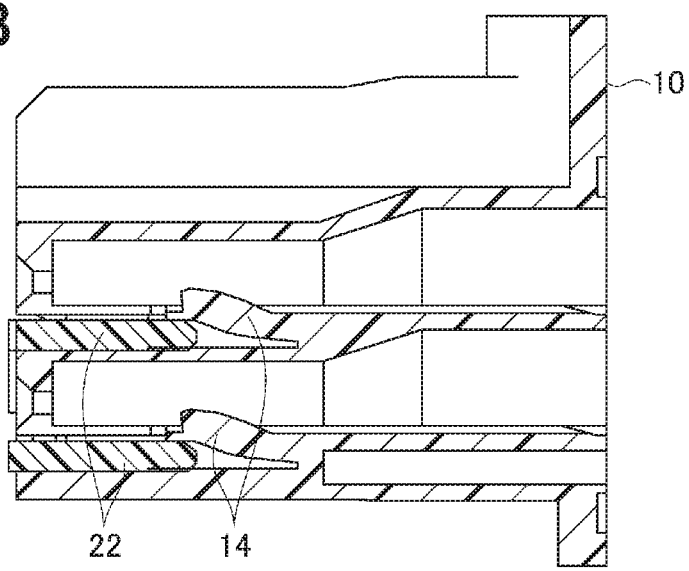

In the state where the front holder 20 is in the "regular" locking position shown in FIG. 2B (and where the female terminals are normally housed in the terminal housing chambers 11), as shown in FIG. 5A (the A-A cross section of FIG. 3), the protrusion 21*b* climbs over the protrusion 13. Moreover, as shown in FIG. 5B (the B-B cross section of FIG. 3), the double locking portions 22 enter the space below the lances 14 and push the lances 14 toward the female terminals (upward). For this reason, a so-called double locking state is obtained where the lances 14 lock the female terminals and the double locking portions 22 lock the lances 14 (in the regular positions where the coming-off prevention function is fulfilled). By this double locking, the prevention of coming-off of the female terminals normally housed in the terminal housing chambers 11 is more ensured.

As described above, in the state where the front holder 20 is in the "regular" locking position, the front holder 20 can be held in the "regular" locking position as long as no external force acts thereon.

Like the front holder 20, the front holder 40 is, although not shown, inserted into the male housing 30 from the front side, and inserted up to the "regular" locking position (state where the front holder 40 is completely inserted) by way of the "temporary" locking position (state where the front holder 40 is in the halfway inserted state).

Figure 6:
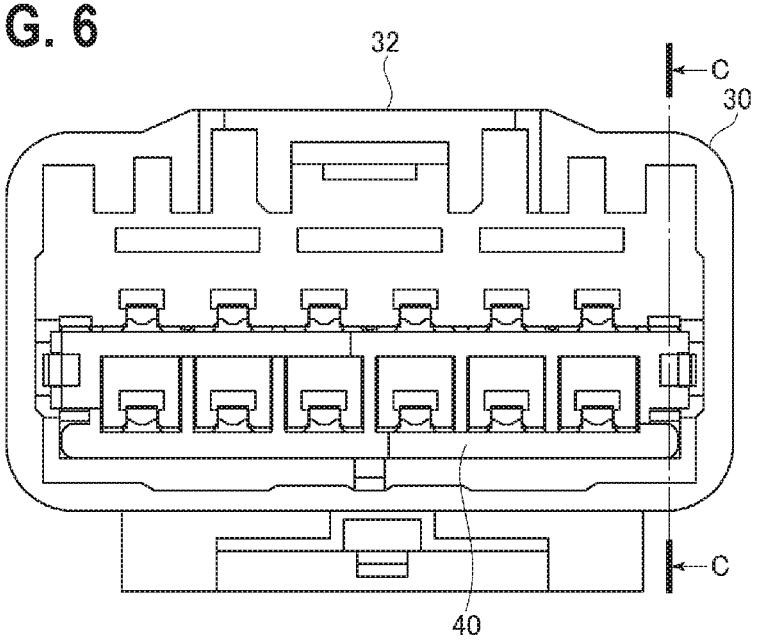
FIG. 6 is a view when a male housing shown in FIG. 1 is viewed from the front side.
Figure 7A:
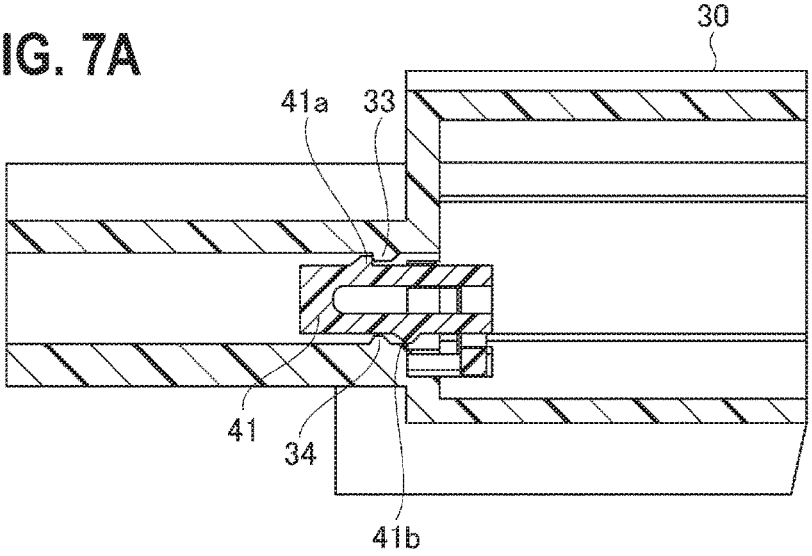
FIGS. 7A and 7B show cross-sectional views of the male housing shown in FIG. 1.

In the state where the front holder 40 is in the "temporary" locking position, as shown in FIG. 7A (the C-C cross section of FIG. 6), a protrusion 41*a* provided on the arm 41 climbs over a protrusion 33 provided on the male housing 30, whereas a protrusion 41*b* provided on the arm 41 does not climb over a protrusion 34 provided on the male housing 30. Therefore, the front holder 40 is held in the "temporary" locking position as long as no external force acts thereon. Moreover, although not shown, the double locking portions 42 do not reach the positions of the lances provided on the male housing 30.

Figure 7B:
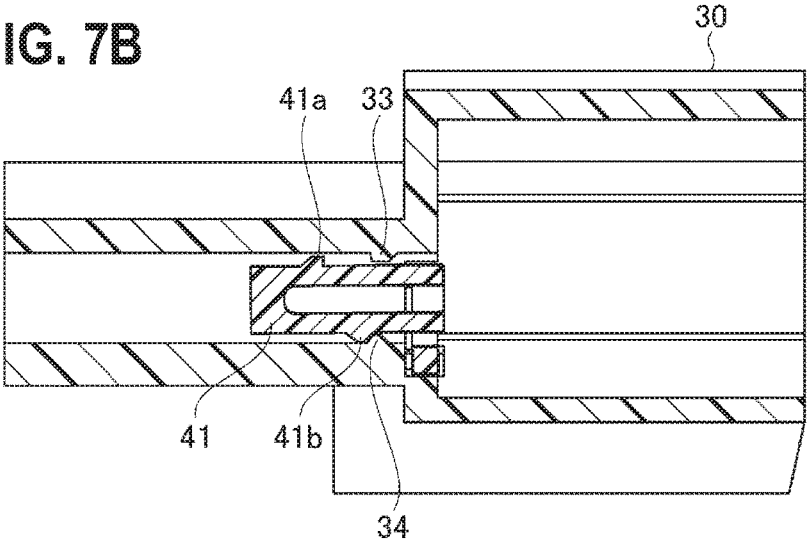

On the other hand, in the state where the front holder 40 is in the "regular" locking position (and where the male terminals are normally housed in the terminal housing chambers 31), as shown in FIG. 7B (the C-C cross section of FIG. 6), the protrusion 41*b* climbs over the protrusion 34. Moreover, although not shown, the double locking portions 42 enters the space below the lances and push the lances toward the male terminals (upward). Therefore, the front holder 40 can be held in the "regular" locking position as long as no external force acts thereon.

By the cooperation between the lances provided on the male housing 30 and the double locking portions 42 of the front holder 40, the presence or absence of the halfway inserted state of the male terminals can be detected as in the case of the lances 14 provided on the female housing 10 and the double locking portions 22 of the front holder 20, and by the double locking, the prevention of coming-off of the male terminals normally housed in the terminal housing chambers 31 is more ensured.

Figure 8:
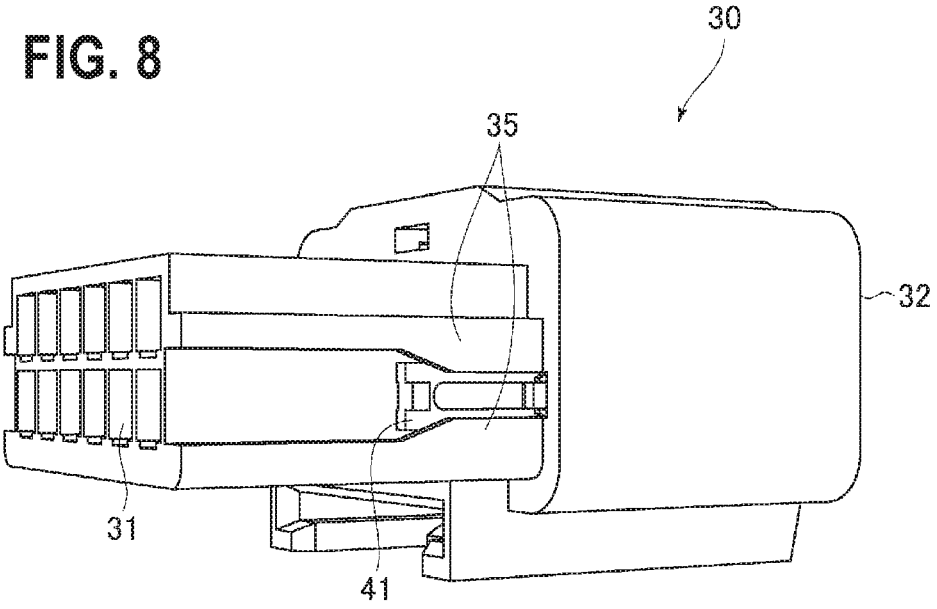
FIG. 8 is a perspective view when the male housing shown in FIG. 1 is viewed obliquely from behind.

Moreover, as shown in FIG. 8, in the state where the front holder 40 is in the "regular" locking position, only the end portions of the arms 41 of the front holder 40 are exposed from the inclined end surfaces of covers 35 attached to the male housing 30. Therefore, when the front holder 40 is separated from the male housing 30 by pushing out the arms 41, the work of pushing out the arms 41 is facilitated. On the other hand, when such separation is not performed (for example, at the time of normal use), the worker's hand or the like is prevented from unintentionally touching the arms 41.

(Detailed Configurations of the Front Holder and the Front Holder Attachment Position of the Housing)

Next, detailed configurations of the front holder 20 and the front holder attachment position of the female housing 10 will be described.

Figure 9A:
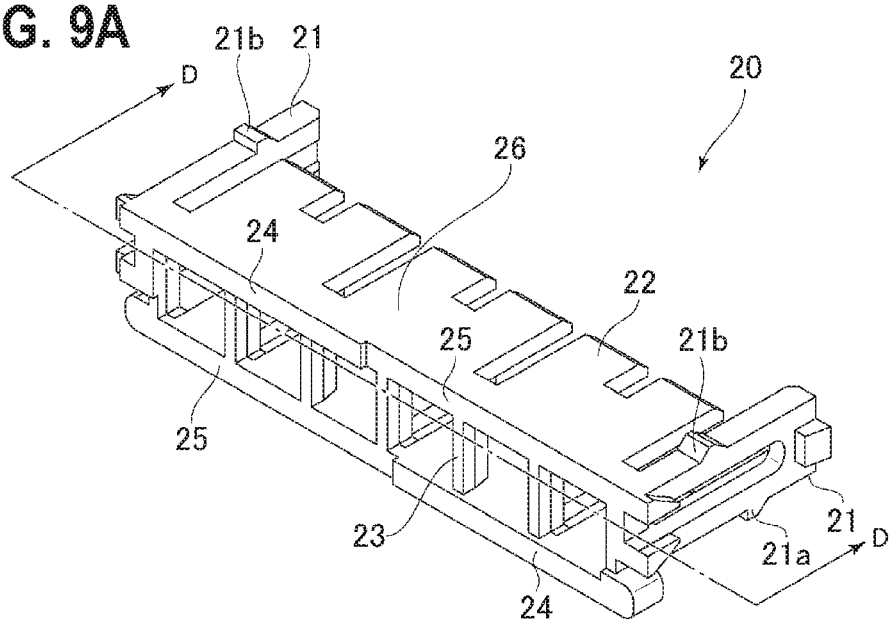
FIGS. 9A and 9B shows the female side front holder shown in FIG. 1.
Figure 9B:
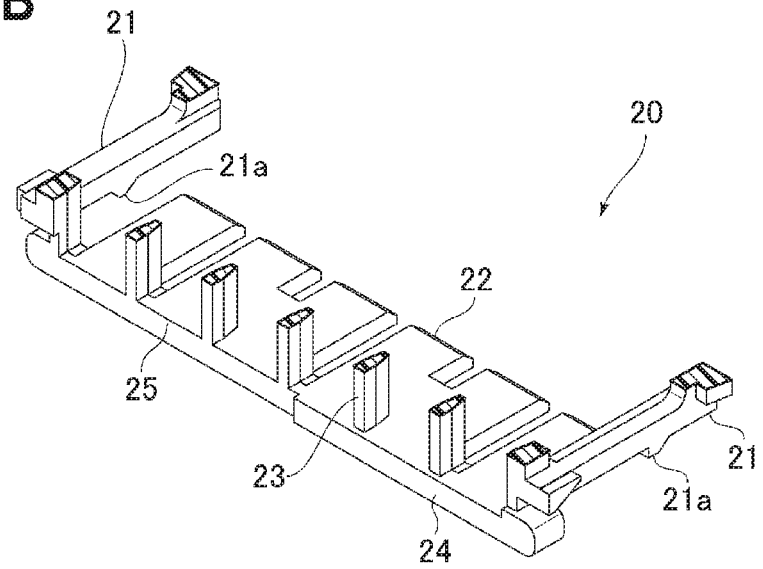

As shown in FIG. 9A, the front holder 20 is provided with a plurality of (in this example, five) plate-like ribs 23 that connects in the vertical direction the upper wall and the lower wall of a frame 26 in the frame 26 having quadrilateral cross section. In other words, the ribs 23 extend in a direction perpendicular to the fitting direction of the front holder 20. The ribs 23 are provided in positions corresponding to the intervals between the adjoining terminal housing chambers 11 of a plurality of (in this example, six) terminal housing chambers 11 in the width direction. As shown in FIG. 9B (the D-D cross section of FIG. 9A), the cross section perpendicular to the extension direction (vertical direction) of the ribs 23 (the cross section along the plane parallel to the fitting direction and the width direction) has a flat shape long in the fitting direction and short in the width direction. The above-mentioned pair of arms 21 and the above-mentioned plurality of double locking portions 22 protrude rearward from both side surfaces in the width direction of the frame 26 and the upper and lower walls of the frame 26, respectively.

Moreover, the front end surface of the front holder 20 (more specifically, the front surfaces of the upper and lower walls of the frame 26) is formed of convex portions 24 and concave portions 25 so as to be uneven. In this example, on the front surface of the upper wall of the frame 26, the convex portion 24 and the concave portion 25 are formed on one side and on the other side in the width direction, respectively, and on the front surface of the lower wall of the frame 26, the concave portion 25 and the convex portion 24 are formed on one side and on the other side in the width direction, respectively. The front holder 40 has substantially the same configuration as the front holder 20 (see FIG. 14).

Figure 10A:
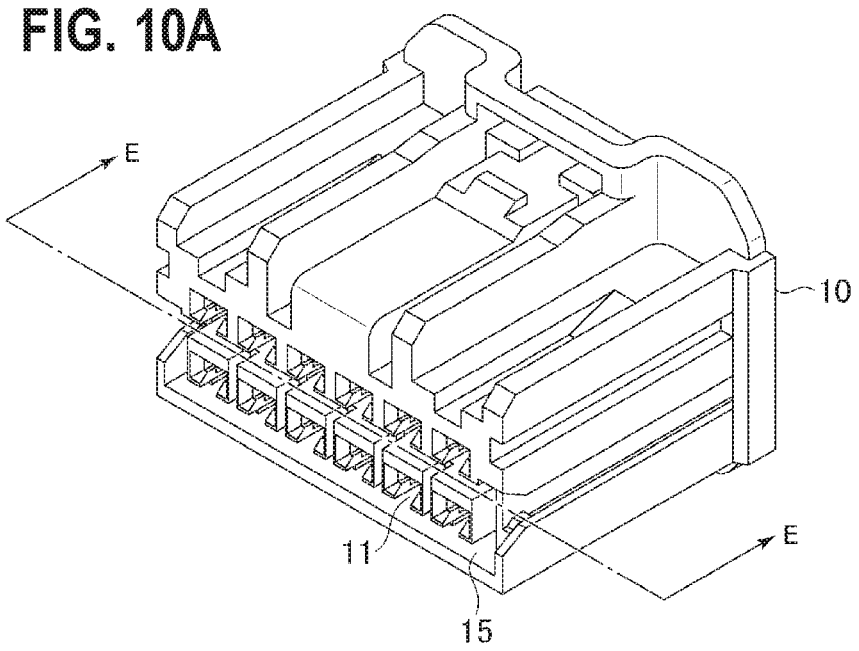
FIGS. 10A and 10B show the female housing shown in FIG. 1.
Figure 10B:
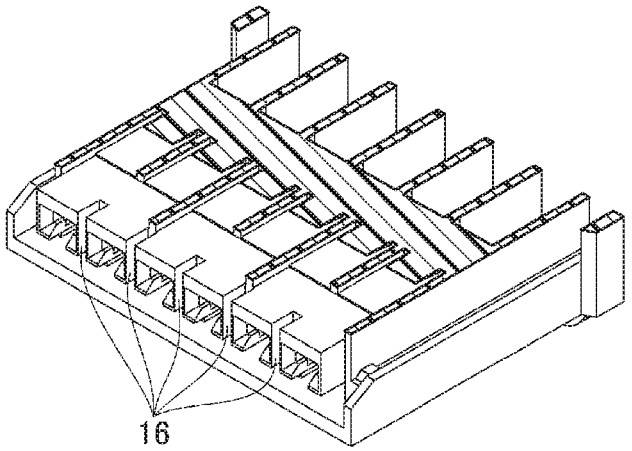

As shown in FIG. 10A, the front side end portion of the female housing 10 is the front holder attachment position 15. As shown in FIG. 10B, on this front holder attachment position 15, grooves 16 extending in the vertical direction and open to the front side are provided in a plurality of (in this example, five) positions corresponding to the positions of a plurality of (in this example, five) ribs 23 in the width direction. In other words, the grooves 16 are depressed in a shape capable of housing the above-mentioned ribs 23 while supporting them and extend in a direction in which the ribs 23 extend.

In the state where the front holder 20 is attached to the female housing 10 up to the "regular" locking position, the ribs 23 of the front holder 20 are inserted and supported in the corresponding grooves 16. Thereby, the movement and torsion of the front holder 20 in the width direction can be suppressed.

Figure 11:
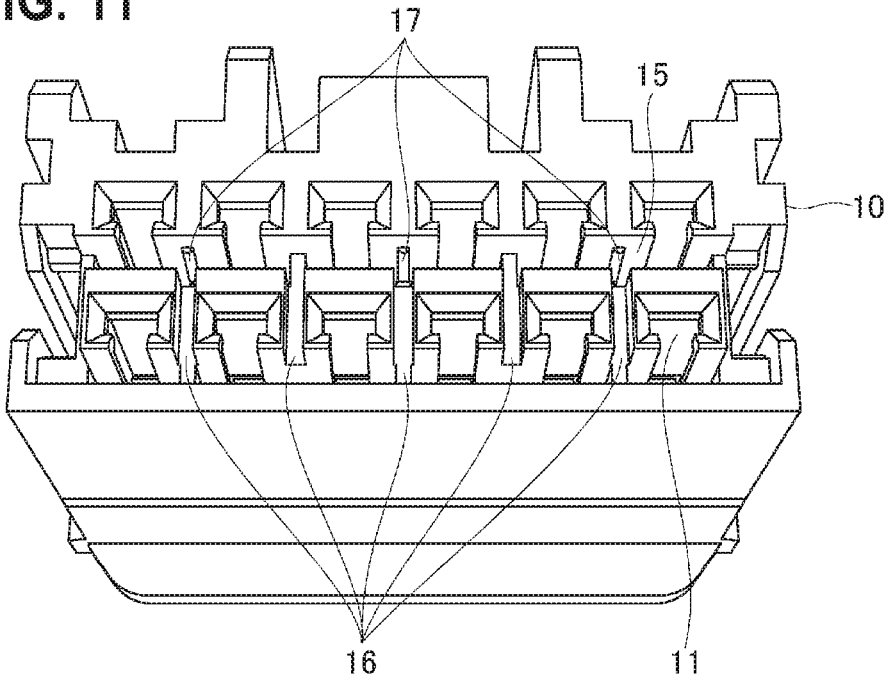
FIG. 11 is a perspective view when the female housing shown in FIG. 1 is viewed obliquely from below.

As shown in FIG. 11, on the upper surface of the front holder attachment position 15 of the female housing 10, crest-like protrusions 17 are formed that protrude downward (the extension direction of the grooves 16) and extend in the fitting direction of the front holder 20. In this example, the protrusions 17 are formed in three positions in the width direction, respectively.

Figure 12A:
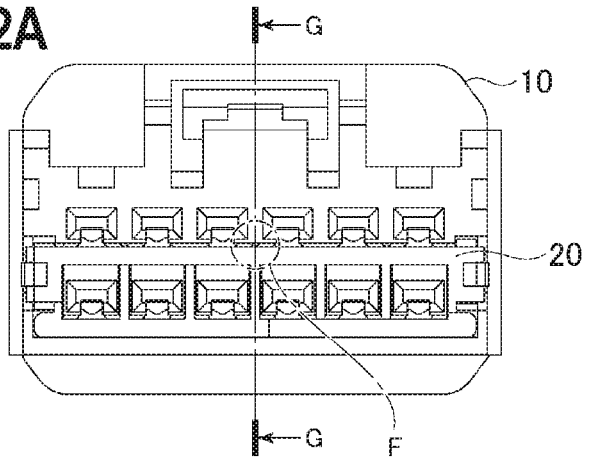
FIGS. 12A to 12C are views for explaining protrusions that the female housing shown in FIG. 1 has.
Figure 12B:
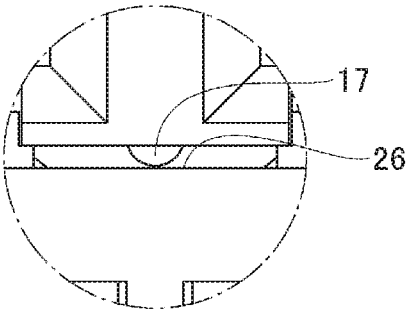
Figure 12C:
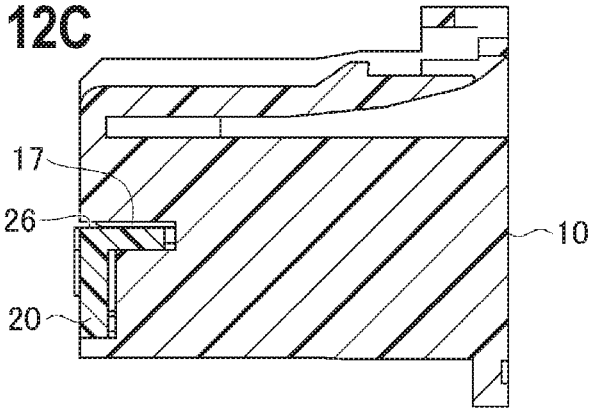

In the state where the front holder 20 is attached to the female housing 10 up to the "regular" locking position, as shown in FIG. 12, these three protrusions 17 are in contact with three positions of a central part in the width direction on the upper surface of the upper wall of the frame 26 of the front holder 20, a part on the one side in the width direction of the central part and a part on the other side in the width direction of the central part, respectively. Thereby, the movement and torsion of the front holder 20 in the vertical direction can be suppressed.

Figure 13A:
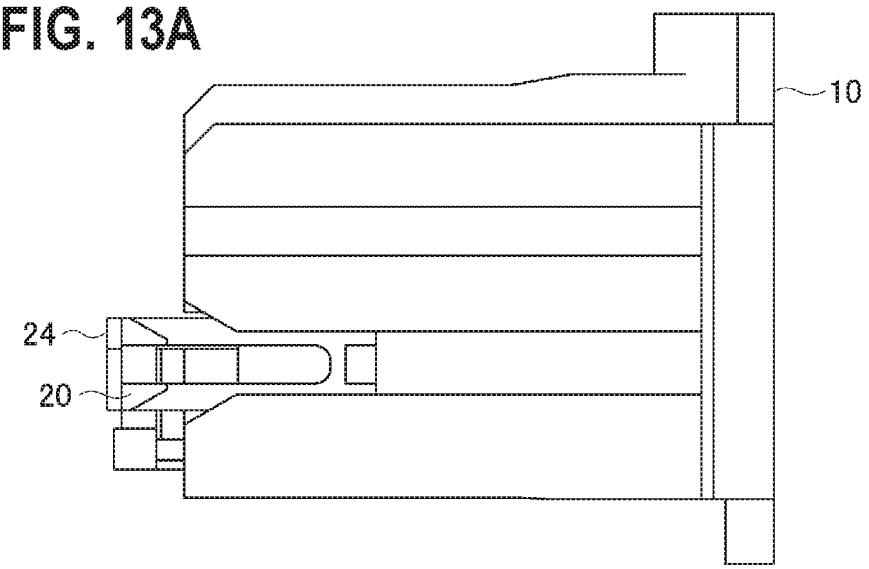
FIGS. 13A and 13B show states where the female side front holder is attached to the female housing shown in FIG. 1.
Figure 13B:
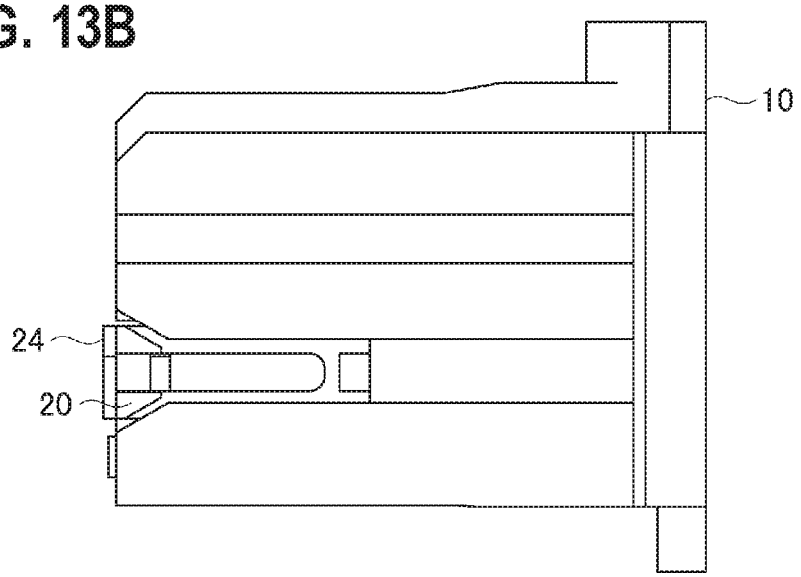

As shown in FIG. 13A, in the state where the front holder 20 is attached to the female housing 10 up to the "regular" locking position of the female housing 10, the convex portions 24 on the front end surface of the front holder 20 (see also FIG. 9A) protrude from the front end surface of the female housing 10. Thereby, the following working and advantage can be produced.

That is, when the female terminals are in the halfway inserted state, as described above, since the lances 14 bend downward, the front holder 20 cannot move from the "temporary" locking position to the "regular" locking position. As a result, normally, the front end surface of the front holder 20 protrudes from the front end surface of the female housing 10.

However, because of variations in the dimensional accuracy and the like of the female housing 10 and the front holder 20, even though the female terminals are in the halfway inserted state, there are cases where the front holder 20 can move to a position close to the "regular" locking position. In these cases, although the female terminals are in the halfway inserted state, a possibility can occur that the front end surface of the front holder 20 appears not to protrude from the front end surface of the female housing 10. As a result, there is a possibility that the worker does not notice the halfway inserted state of the female terminals.

In this regard, the front end surface of the front holder 20 is formed of the convex portions 24 and the concave portions 25 so as to be uneven. For this reason, even when the front holder 20 moves to the position close to the "regular" locking position, the frontward protrusion of the front holder 20 is conspicuous compared with when the front end surface of the front holder is flat. As a result, the worker readily notices the halfway inserted state of the female terminals.

The detailed configurations of the front holder 20 and the female housing 10 have been described above. In the front holder 40, ribs, convex portions 43 and concave portions 44 corresponding to the ribs 23, the convex portions 24 and the concave portions 25 of the front holder 20 are also formed (see also FIGS. 14A and 14B). In addition, in the male housing 30, although not shown, grooves and protrusions corresponding to the grooves 16 and the protrusions 17 of the female housing 10 are formed.

Therefore, in the relationship between the front holder 40 and the male housing 30, as in the relationship between the front holder 20 and the female housing 10, as described above, the movement and torsion of the front holder 40 in the width direction and the movement and torsion of the front holder 40 in the vertical direction can be suppressed. Moreover, when the male terminals are in the halfway inserted state, since the frontward protrusion of the front holder 40 is conspicuous, the worker readily notices the halfway inserted state of the male terminals.

Figure 14A:
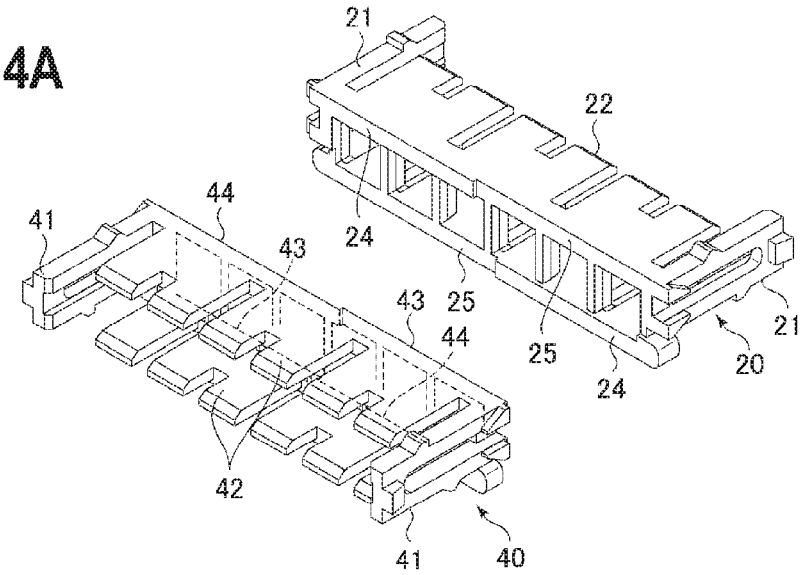
FIG. 14A shows a state where the male side front holder and the female side front holder shown in FIG. 1 face each other in a state of being close to each other when the male housing and the female housing are fitted (when the connectors are fitted)
Figure 14B:
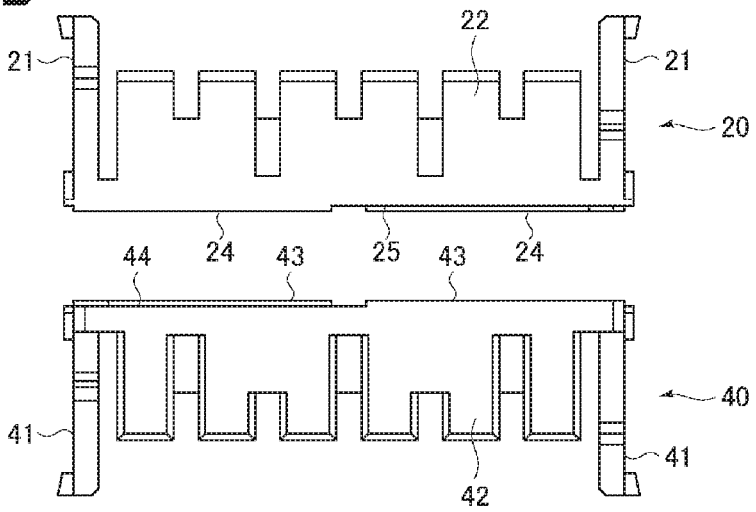
FIG. 14B is an upper view and a lower view of the female side front holder.

As described above, the front holder 40 has substantially the same configuration as the front holder 20. Therefore, as shown in FIGS. 14A and 14B, the front end surface of the front holder 40 is also formed of the convex portions 43 and the concave portions 44 so as to be uneven like the front holder 20.

Figure 15:
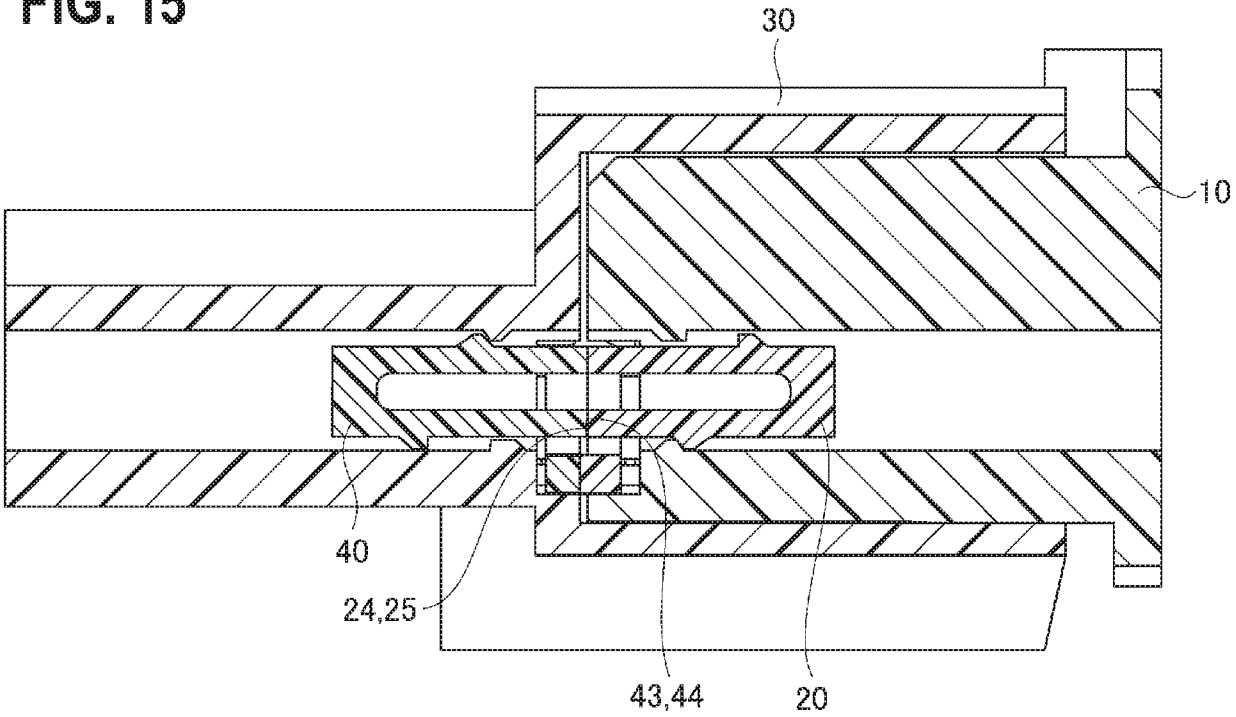
FIG. 15 is a schematic view showing a state where the male housing and the female housing shown in FIG. 1 are fitted.

As shown in FIG. 15, in the fitting completed state of the female housing 10 and the male housing 30 (state where fitting of a pair of connectors is completed), the front surfaces of both of the front holder 20 and the front holder 40 are in contact with each other. Under this state, the convex portions 24 and the concave portions 25 on the side of the front holder 20 are in contact with the concave portions 44 and the convex portions 43 on the side of the front holder 40, respectively.

Here, when simple convex portions are provided on the front end surface of the front holder, the length of the front holder in the fitting direction is increased, so that the overall length of the connector (=the female housing+the male housing) is increased. On the contrary, uneven convex portions and concave portions are provided on the front end surfaces of both of the front holder 20 and the front holder 40, and when the fitting of the female housing 10 and the male housing 30 is completed, the convex portions and the concave portions of the front holders are in contact with each other. Therefore, even though the convex portions are provided on the front end surface of the front holder, increase in the sizes of the connectors can be suppressed.

Further, as described above, a common holder may be used as each of the front holder 20 and the front holder 40 since they have substantially the same configuration. As a result, compared with when a common holder cannot be used as each of the front holder 20 and the front holder 40 (the configurations thereof are different), the number of components of the connectors can be reduced, whereby the component management and the like at the time of manufacture of the connectors is facilitated. In addition, since it is unnecessary to prepare an individual (different) manufacturing mold and the like for each of the front holders 20 and 40, the manufacturing cost of the front holders 20 and 40 can be reduced, so that the manufacturing cost of the connectors can be reduced.

(Simplification of Detachment of the Front Holder from the Male Housing)

Next, the simplification of detachment of the front holder 40 from the male housing 30 will be described.

Figure 16A:
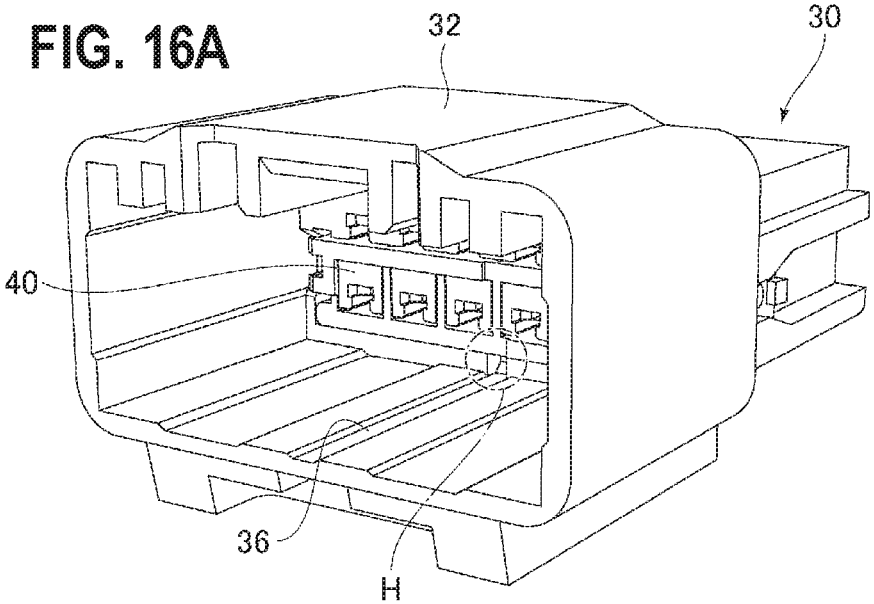
FIGS. 16A and 16B are views for explaining a guide groove that the male housing shown in FIG. 1 has.

As shown in FIG. 16A, the male housing 30 is integrally provided with the tubular surrounding portion 32 surrounding the end portions of the male terminals (not shown). The presence of this surrounding portion 32 makes difficult the detachment, from the male housing 30, of the front holder 40 attached to the male housing 30.

Figure 16B:
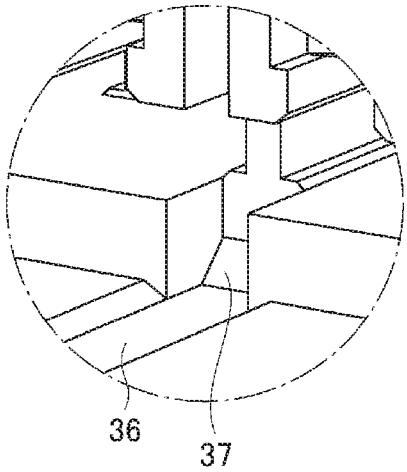

In this regard, as shown in FIG. 16A, on the lower surface of the inner wall of the surrounding portion 32 of the male housing 30, a guide groove 36 for front holder detachment is formed in the fitting direction. As shown in FIG. 16B (an enlarged view of the H part of FIG. 16A), in a part on the innermost side (rear side) of this guide groove 36, an inclined portion 37 is provided that is inclined upward from the lower surface of the inner wall of the surrounding portion 32 (that is, in a direction approaching the front holder 40). In FIG. 16B, for convenience' sake, illustration of the front holder 40 is omitted.

Figure 17A:
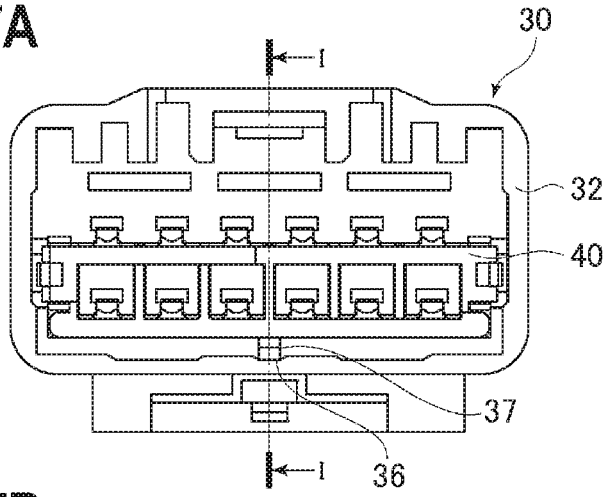
FIGS. 17A to 17C are views for explaining the process of detaching the male side front holder attached to the male housing shown in FIG. 1.
Figure 17B:
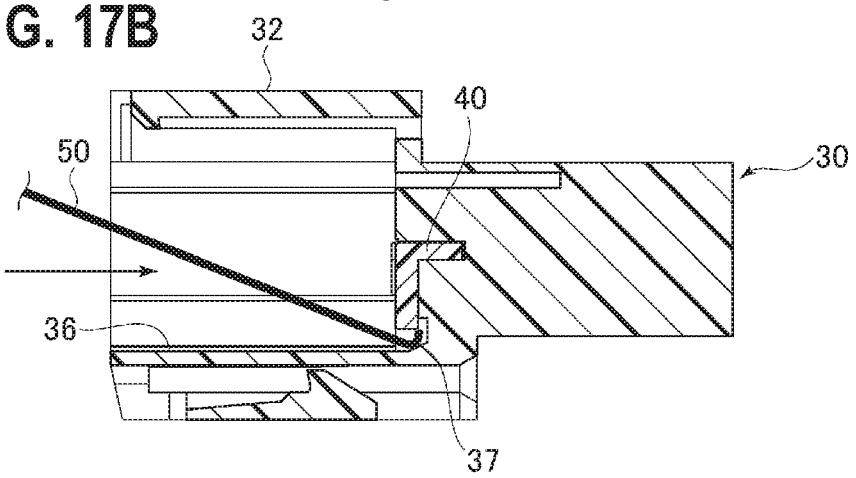
Figure 17C:
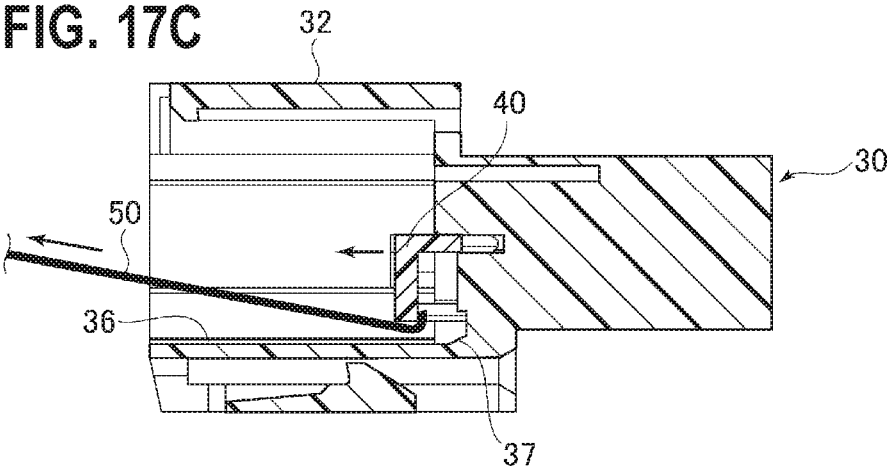

As shown in FIGS. 17B and 17C, when the front holder 40 attached to the male housing 30 is detached from the male housing 30, a bar-shaped front holder separation rod 50 the end portion of which is bent is used. That is, first, as shown in FIG. 17B, the front holder separation rod 50 is inserted in such a manner as to slide toward the front holder 40 along the guide groove 36 while being maintained in a direction where its end portion bends upward. When the front holder separation rod 50 reaches the inclined portion 37 on the inner side of the guide groove 36, the front holder separation rod 50 is guided by the inclined portion 37 to approach the lower surface of the front holder 40.

Then, as shown in FIG. 17C, the front holder separation rod 50 is hooked on a predetermined part of the front holder 40 and drawn out toward the outside (front side), whereby the front holder 40 can be taken out. As a result, even though the front holder 40 is attached to an inner position away from the opening of the surrounding portion 32 as in the male housing 30, the front holder 40 can be easily detached.

(Workings and Advantages)

According to the connector device of the embodiment of the present invention, the front end surface of the front holder 20 is formed of the convex portions 24 and the concave portions 25 so as to be uneven, and the front end surface of the front holder 40 is formed of the convex portions 43 and the concave portions 44 so as to be uneven. For this reason, even when the front holders 20 and 40 move to positions close to the "regular" locking positions when the terminals are in the halfway inserted state, the frontward protrusion of the front holders 20 and 40 (particularly, the protrusion of the convex portions 24 and 43) are conspicuous compared with when the front end surfaces of the front holders 20 and 40 are flat. As a result, the worker more readily recognizes the halfway inserted state of the terminals.

Further, even though the convex portions 24 and 43 are formed on the front end surfaces of the front holders 20 and 40, the convex portions of one front holder are inserted in the concave portions of the other front holder when the connectors are fitted. Therefore, even though the convex portions 24 and 43 are provided on the front end surfaces of the front holders 20 and 40, increase in the size of the connector device can be avoided.

Further, since the front holders 20 and 40 have substantially the same configuration, a common holder may be used as each of the front holders 20 and 40. Consequently, the number of components of the connectors can be reduced, whereby the component management and the like at the time of manufacture of the connectors is facilitated. Further, the manufacturing cost of the pair of front holders can be reduced, so that the manufacturing cost of the connectors can be reduced.

Therefore, according to the connector device of the embodiment of the present invention, the halfway insertion of the terminals can be detected as surely as possible.

(Other Modes)

The present invention is not limited to the above-described embodiment and various modifications may be adopted within the gist of the present invention. For example, the present invention is not limited to the above-described embodiment, and modifications, improvements and the like are possible as appropriate. Besides, the materials, shapes, dimensions, numbers, disposition positions and the like of the elements of the above-described embodiment are arbitrary as long as the present invention is attained, and are not limited.

For example, in the above-described embodiment, the front holders 20 and 40 each have one convex portion and one concave portion formed thereon. However, from the viewpoint of more effectively detecting the halfway inserted state of the terminals, a structure may be adopted where a plurality of convex portions and concave portions are formed on the front holder 20 and the same number of plurality of convex portions and concave portions are formed on the front holder 40.

Now, features of the above-described embodiment of the connector device according to the present invention are briefly summarized and listed in the following (1) to (3):

(1)

A connector device comprising a pair of connectors having: a pair of housings (10, 30) having terminal housing chambers (11) housing terminals; and a pair of front holders (20, 40) attached to the housings, respectively, and double-locking the terminals in the terminal housing chambers, wherein one (20) of the pair of front holders has a first convex portion (24) protruding in a direction approaching the other (40) of the pair of front holders and a first concave portion (25) recessed in a direction away from the other (40) of the pair of front holders, on a front end surface that faces the other (40) of the pair of front holders when the pair of connectors are fitted, the other (40) of the pair of front holders has a second convex portion (43) protruding in a direction approaching the one (20) of the pair of front holders and a second concave portion (44) recessed in a direction away from the one (20) of the pair of front holders, on a front end surface that faces the one (20) of the pair of front holders when the pair of connectors are fitted, and the first convex portion (24) is inserted into the second concave portion (44) and the second convex portion (43) is inserted into the first concave portion (25), whereby the front end surfaces of the pair of front holders (20, 40) are in contact with each other.

(2)

The connector device according to the above (1), wherein the one (20) of the pair of front holders has a plurality of the first convex portions (24) and a plurality of the first concave portions (25), and the other (40) of the pair of front holders has a plurality of the second convex portions (43) as many as the first convex portions (24) and a plurality of the second concave portions (44) as many as the first concave portions (25).

(3)

The connector device according to the above (1) or the above (2), wherein a common holder may be used as each of the one (20) of the pair of front holders and the other (40) of the pair of front holders.

What is claimed is:

1. A connector device comprising:

a pair of connectors;

a pair of housings, each housing including a terminal housing chamber configured for housing terminals; and a pair of front holders that is attached to the pair of the housings to double-lock the terminals in the terminal housing chambers, wherein one of the pair of front holders includes a first convex portion protruding in a direction approaching the other of the pair of front holders and a first concave portion recessed in a direction away from the other of the pair of front holders, on a front end surface thereof that faces the other of the pair of front holders when a pair of connectors are fitted, the other of the pair of front holders includes a second convex portion protruding in a direction approaching the one of the pair of front holders and a second concave portion recessed in a direction away from the one of the pair of front holders, on a front end surface thereof that faces the one of the pair of front holders when the pair of connectors are fitted, and the first convex portion is inserted into the second concave portion, the second convex portion is inserted into the first concave portion, and the front end surfaces of the pair of front holders are in contact with each other, wherein the plurality of the first convex portions provided to the one of the pair of front holders has a combined length which extends substantially across the entire width of the one of the pair of front holders, and wherein the plurality of the second convex portions provided to the other of the pair of front holders has a combined length which extends substantially across the entire width of the other of the pair of front holders.

2. The connector device according to claim 1, wherein the one of the pair of front holders includes a plurality of the first convex portions and a plurality of the first concave portions, and the other of the pair of front holders includes a plurality of the second convex portions in a number corresponding to the plurality of the first convex portions and a plurality of the second concave portions in a number corresponding to the plurality of the first concave portions.

3. The connector device according to claim 1, wherein a common holder is used as each of the one of the pair of front holders and the other of the pair of front holders.

4. The connector device according to claim 2, wherein a common holder is used as each of the one of the pair of front holders and the other of the pair of front holders.

5. The connector device according to claim 1, wherein an outer shape of the one of the pair of front holders is the same as an outer shape of the other of the pair of front holders.

* * * * *